US010030503B2

(12) United States Patent
Sallwasser et al.

(10) Patent No.: US 10,030,503 B2
(45) Date of Patent: Jul. 24, 2018

(54) SPRING WITH INTEGRAL BOREHOLE WALL APPLIED SENSOR

(71) Applicant: Schlumberger Technology Corporation, Sugar Land, TX (US)

(72) Inventors: Alan J. Sallwasser, Houston, TX (US); Julien Toniolo, Houston, TX (US); Peter Wells, Houston, TX (US); Mark A. Fredette, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 182 days.

(21) Appl. No.: 14/627,920

(22) Filed: Feb. 20, 2015

(65) Prior Publication Data

US 2016/0245069 A1 Aug. 25, 2016

(51) Int. Cl.
*E21B 47/01* (2012.01)
*E21B 47/08* (2012.01)

(52) U.S. Cl.
CPC ..... *E21B 47/08* (2013.01); *E21B 47/011* (2013.01)

(58) Field of Classification Search
CPC ..... E21B 47/08; E21B 47/011
USPC ..... 175/50
See application file for complete search history.

(56) References Cited

U.S. PATENT DOCUMENTS

| | | | | |
|---|---|---|---|---|
| 3,685,158 | A | 8/1972 | Planche | |
| 5,022,484 | A | 6/1991 | Panetta et al. | |
| 6,283,205 | B1 * | 9/2001 | Cannon | E21B 17/105 166/241.1 |
| 2008/0291048 | A1 * | 11/2008 | Huiszoon | E21B 47/082 340/856.3 |
| 2009/0195244 | A1 | 8/2009 | Mouget et al. | |
| 2010/0108386 | A1 * | 5/2010 | Martinez | E21B 47/08 175/45 |
| 2012/0055711 | A1 * | 3/2012 | Brannigan | E21B 47/08 175/50 |
| 2012/0241172 | A1 * | 9/2012 | Ludwig | E21B 47/011 166/382 |
| 2014/0008059 | A1 * | 1/2014 | Macrae | E21B 47/12 166/250.01 |
| 2014/0311758 | A1 * | 10/2014 | Varkey | H01B 7/046 166/385 |

* cited by examiner

*Primary Examiner* — Taras P Bemko
(74) *Attorney, Agent, or Firm* — Sara K. M. Hinkley

(57) ABSTRACT

A downhole tool includes a logging tool. The logging tool includes a spring integral with a sensor. The spring applies the sensor to a formation wall. Additionally, the spring includes a groove formed along a neutral axis thereof. In addition, a wire is located within the groove and is operatively connected with the sensor and at least one other component of the logging tool.

17 Claims, 5 Drawing Sheets

SPRING WITH INTEGRAL BOREHOLE WALL APPLIED SENSOR

BACKGROUND

The present disclosure relates generally to the field of downhole tools and, more particularly, to a downhole caliper tool system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions.

In hydrocarbon drilling operations, downhole tools may be lowered into a borehole to perform specific tasks. For example, a logging string system may be lowered through a drill string or downhole tubular. The logging string system includes a logging tool that takes various measurements, which may range from common measurements such as pressure or temperature to advanced measurements such as rock properties, fracture analysis, fluid properties in the wellbore, or formation properties extending into the rock formation. Some logging tools contact the borehole to obtain various measurements.

In certain cases, the logging tool includes mechanical linkages and components to facilitate expansion of the logging tool after the logging tool passes through the drill string or downhole tubular. The mechanical linkages are exposed to borehole pressures, as well as fluids having high viscosities or particulates. The borehole environment may degrade the logging tool, thereby resulting in more frequent repairs or replacements.

SUMMARY OF DISCLOSED EMBODIMENTS

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a downhole tool includes a logging tool. The logging tool includes a spring integral with a sensor. The spring applies the sensor to a formation wall. Additionally, the spring includes a groove formed along a neutral axis thereof. In addition, a wire is located within the groove and is operatively connected with the sensor and at least one other component of the logging tool.

In another embodiment, a downhole tool includes a linkage-less caliper tool. The linkage-less caliper tool includes a spring that drives radial movement of a sensor disposed on the spring. In addition, the radial movement of the sensor is relative to a logging tool axis of a logging tool positioned in a borehole.

In a further embodiment, a downhole tool includes a drill string that may be disposed in a borehole in a formation. The downhole tool also includes a drill bit coupled to an end of the drill string. The drill bit engages the formation to form the borehole. Moreover, the downhole tool includes a logging tool positioned within the drill string. The logging tool may extend through the drill bit. Additionally, the logging tool includes a spring having a groove along a neutral axis of the spring.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended just to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are just examples of the presently disclosed techniques. Additionally, in an effort to provide a concise description of these embodiments, some features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure are directed toward a logging tool having a caliper tool with springs that enable radial movement of a sensor disposed on the caliper tool. In certain embodiments, the sensor moves radially with respect to the logging tool axis, via the springs. The spring may include an integrated sensor that takes borehole measurements. For example, the sensor may couple two spring sections to form the caliper tool. In certain embodiments, the spring may extend through a housing. In other embodiments, the spring includes a groove having a generally T-shaped cross section. The groove houses communication cables for communicatively coupling the sensor to the logging tool. Additionally, in certain embodiments, the spring includes bumpers that contact the sidewall. Spring sections between the bumpers may drive the sensor away from the sidewall while the bumpers are engaged with the sidewall.

Figure 1:
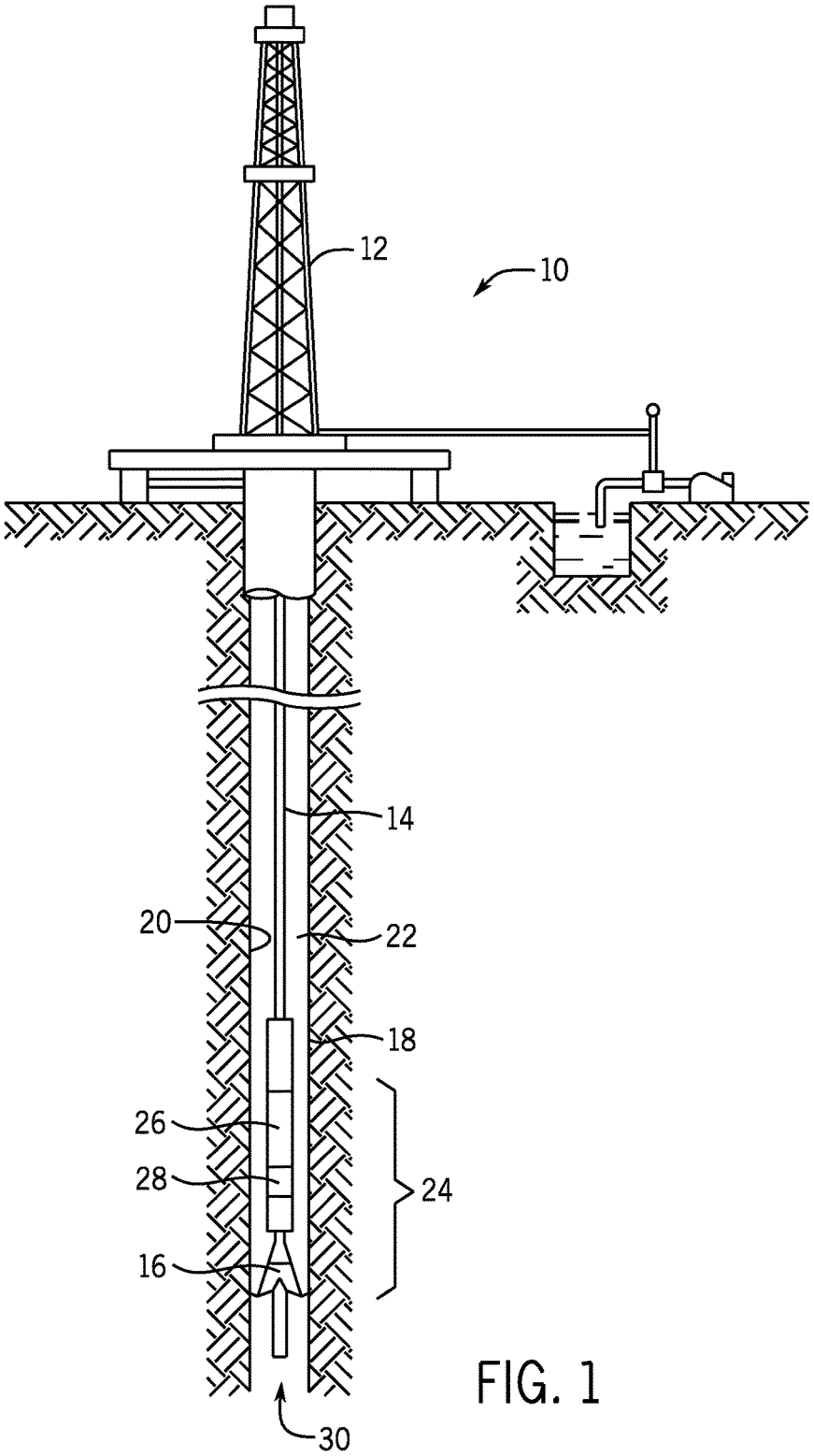
FIG. 1 shows a schematic view of an embodiment of a drilling system, in accordance with various embodiments of the present disclosure.

Referring now to FIG. 1, an embodiment of a downhole drilling system 10 (e.g., drilling system) comprises a rig 12 and a drill string 14 coupled to the rig 12. The drill string 14 includes a drill bit 16 at a distal end that may be rotated to engage a formation and form a borehole 18. As shown, the borehole 18 includes a borehole sidewall 20 and an annulus 22 between the borehole 18 and the drill string 14. Moreover, a bottom hole assembly (BHA) 24 is positioned at the bottom of the borehole 18. The BHA 24 may include a drill collar 26, stabilizers 28, or the like.

During operation, drilling mud or drilling fluid is pumped through the drill string 14 and out of the drill bit 16. The drilling mud flows into the annulus 22 and removes cuttings from a face of the drill bit 16. Moreover, the drilling mud may cool the drill bit 16 during drilling operations. In the illustrated embodiment, the drilling system 10 includes a logging tool 30. As shown, the logging tool 30 extends through the drill bit 16. The logging tool 30 conducts downhole logging operations to obtain various measurements in the borehole 18. For example, the logging tool 30 may include sensors (e.g., resistive, nuclear, seismic, etc.) to determine various borehole and/or fluidic properties. Additionally, the logging tool 30 may include sampling tools to obtain core samples, fluid samples, or the like from the borehole 18. Moreover, in certain embodiments, the logging tool 30 includes mechanical measurement devices, such as calipers, to obtain measurements of the borehole 18. While the illustrated embodiment includes a substantially vertical borehole 18, in other embodiments the borehole 18 may be deviated or substantially horizontal. Additionally, while the illustrated embodiment includes the logging tool 30 extending from the drill bit 16, in other embodiments the logging tool 30 may be a separate sub coupled to the drill string 14.

Figure 2:
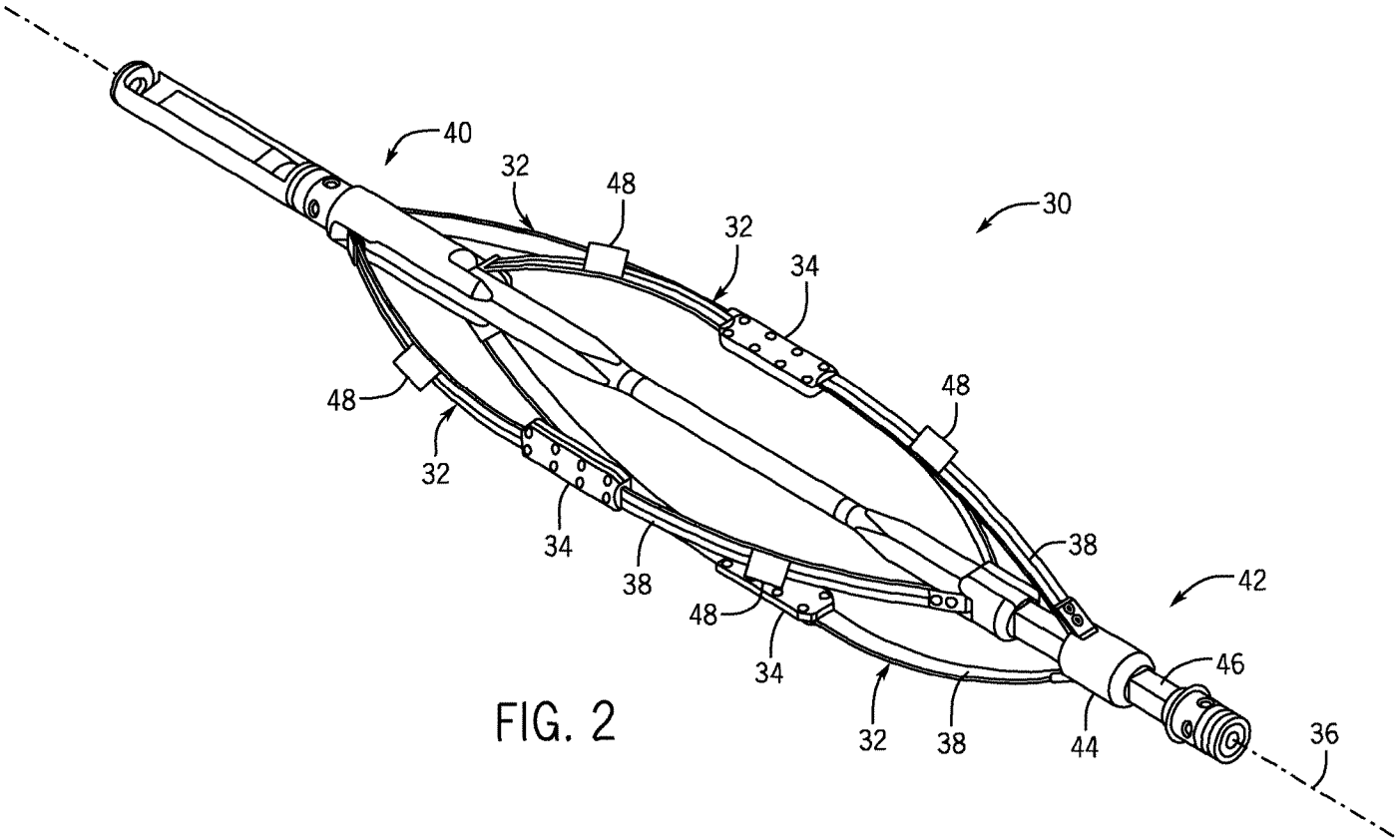
FIG. 2 shows a perspective view of an embodiment of a logging tool having a caliper tool, in accordance with various embodiments of the present disclosure.

FIG. 2 shows an isometric view of an embodiment of the logging tool 30. In the illustrated embodiment, the logging tool 30 includes mechanical calipers 32 (e.g., caliper tool, calipers) and sensors 34. In certain embodiments, the calipers 32 move radially with respect to a logging tool axis 36. That is, the sensor on the calipers may be driven to move radially inward and radially outward, with respect to the logging tool axis 36. The calipers 32 may contact the sidewall 20 of the borehole 18 to obtain various measurements. For example, the calipers 32 may be utilized to determine the diameter of the borehole 18. Additionally, in certain embodiments, the calipers 32 may press the sensors 34 against the sidewall 20 of the borehole 18, thereby enabling additional measurements of the formation (e.g., resistivity, nuclear, etc.). However, in other embodiments, the sensors 34 may be non-contact sensors and may not contact the sidewall 20 of the borehole 18 to obtain formation measurements.

In the illustrated embodiment, the calipers 32 include springs 38 to drive the calipers 32 radially outward with respect to the logging tool axis 36. That is, the springs 38 are biased to enable expansion of the calipers 32 after the logging tool 30 is extended through the drill bit 16. In certain embodiments, the springs 38 may be bow springs. Moreover, in certain embodiments, the springs 38 may be utilized with other downhole tools. For example, the springs 38 may be coupled to stabilizers, centralizers, fishing tool, or the like. However, in other embodiments, the calipers 32 may include mechanical actuators to facilitate deployment of the calipers 32. For example, the mechanical actuators may block expansion of the calipers 32 until activated. In embodiments where the logging tool 30 extends through the drill bit 16, the mechanical actuators may block deployment of the calipers 32 until the logging tool 30 is through the drill bit 16.

As shown, the calipers 32 are coupled to the logging tool 30 at a first location 40 and at a second location 42. The first location 40 is axially farther up the borehole 18 (e.g., closer to the surface) than the second location 42. As will be described below, the first location 40 and the second location 42 may be rigidly fixed to the logging tool 30. However, in other embodiments, the second location 42 may move and/or slide axially along the logging tool axis 36. For example, the second location 42 may be positioned on a hub 44 positioned radially about a tool string 46 of the logging tool 30.

In the illustrated embodiment, four calipers 32 are coupled to the logging tool 30. As shown, the calipers 32 are positioned approximately 90 degrees offset from the adjacent calipers 32. As a result, four measurements may be obtained indicative of the radius of the borehole 18 with respect to the logging tool axis 36. However, in other embodiments, more or fewer calipers 32 may be utilized. For example, 2, 3, 5, 6, 7, 8, or any suitable number of calipers 32 may be positioned on the tool string 46 to obtain borehole measurements. Moreover, in the illustrated embodiment, each hub 44 is coupled to two calipers 32, facilitating multiple independent measurements of the borehole 18. However, in other embodiments, more of fewer hubs 44 may be utilized. For example, each caliper 32 may be independently coupled to a single hub 44.

Returning to the springs 38, in the illustrated embodiment, bumpers 48 are disposed on each side of the sensors 34. In certain embodiments, the bumpers 48 are equidistant from the sensors 34. However, in other embodiments, the bumpers 48 may be located in different locations for anticipated borehole conditions. Furthermore, while two bumpers 48 are shown on each caliper 32, in other embodiments, the calipers 32 may include 1, 3, 4, 5, 6, 7, 8, or any suitable number of bumpers 48. As will be described below, in certain embodiments, the bumpers 48 extend radially farther from the logging tool axis 36 than the sensors 34. As a result, the bumpers 48 may contact the sidewall 20 or an interior surface of the drill string 14 before the sensors 34 while the calipers 32 extend radially out and away from the logging tool axis 36. For example, in certain embodiments, the logging tool 30 may be transported through a tubular to into the borehole 18. While inside the tubular, the bumpers 48 may contact the interior surface of the tubular and urge the sensors 34 away from the interior surface of the tubular.

Figure 3:
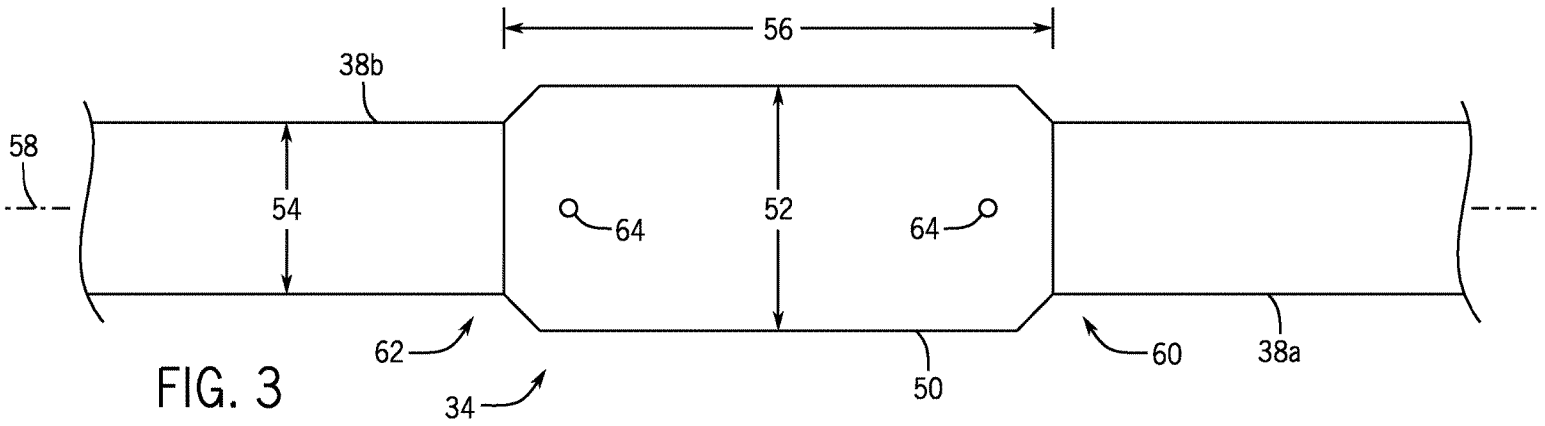
FIG. 3 shows a partial schematic top view of an embodiment of a sensor positioned on a spring of the caliper tool of FIG. 2, in accordance with various embodiments of the present disclosure.

FIG. 3 is a partial top view of the sensor 34 coupled to the springs 38 of the caliper 32. As shown, the sensor 34 includes a housing 50 that stores and fluidly isolates electronic components and/or measurement tools. For example, the housing 50 may include a nuclear measurement source and receiver that emits energy into the formation and receives energy emitted from the formation. Moreover, the housing 50 may include communication electronics to transmit data acquired by the sensor 34. For example, the communication electronics may transmit the data to a telemetry device that transmits the data to a surface controller.

In the illustrated embodiment, the housing 50 has a housing width 52 that is larger than a spring width 54. However, in other embodiments, the housing width 52 may be less than the spring width 54 or equal to the spring width 54. It will be appreciated that the housing width 52 of the housing 50 may be particularly selected to accommodate the electronics within the housing 50 and/or due to borehole conditions. Additionally, the housing 50 extends a length 56 perpendicular to a spring axis 58 (e.g., a neutral axis). The length 56 may be particularly selected to accommodate the electronics within the housing 50. For example, the length 56 may be five percent the length of the springs 38, ten percent the length of the springs 38, fifteen percent the length of the springs 38, twenty percent the length of the springs 38, thirty percent the length of the springs 38, forty percent the length of the springs 38, or any suitable percentage of the length of the springs 38.

As shown in FIG. 3, the housing 50 is coupled to the springs 38 at a first end 60 and a second end 62. For example, fasteners 64 may couple the springs 38 to the housing 50. In certain embodiments, the fasteners 64 are screws, bolts, clamps, or the like. In the illustrated embodiment, the spring 38 is formed from two springs 38*a*, 38*b* (e.g., spring sections). Each spring 38*a*, 38*b* is independently fastened to the housing 50 via the fasteners 64. However, in other embodiments, a single spring 38 may extend through the length 56 of the housing 50. Accordingly, the sensor 34 may be coupled to the spring 38 to form the caliper 32 having an integrated sensor 34.

Figure 4:
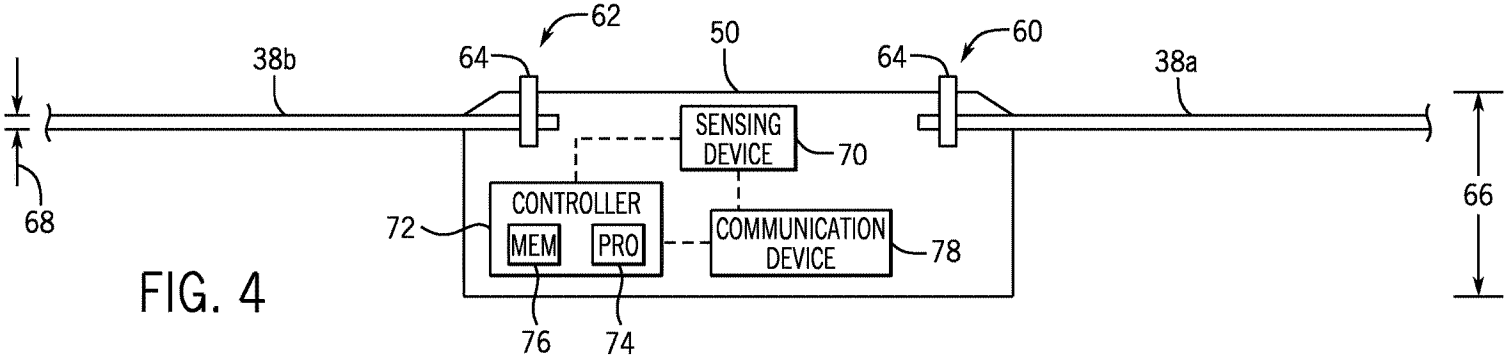
FIG. 4 shows a partial schematic cross-sectional side view of the sensor of FIG. 3, in accordance with various embodiments of the present disclosure.

FIG. 4 is a partial cross-sectional view of the sensor 34 positioned on the spring 38. As described above, the springs 38*a*, 38*b* are coupled to the housing 50 at the first end 60 and the second end 62, respectively. In the illustrated embodiment, the springs 38*a*, 38*b* extending into the housing 50 are engaged by the fasteners 64 to couple the sensor 34 to the spring 38. However, as mentioned above, in certain embodiments, the spring 38 may extend through the length 56 of the housing 50.

As shown, a housing depth 66 of the housing 50 is greater than a spring depth 68 of the spring 38 and houses various electronic or mechanical components of the sensor 34. For instance, in the illustrated embodiment, the sensor 34 includes a sensing device 70. The sensing device 70 may be a device that obtains borehole measurements. For example, the sensing device 70 may be a nuclear sensor, a resistivity sensor, a seismic sensor, or the like. In certain embodiments, the sensing device 70 may include both a source (e.g., radioactive isotope, electrical source, etc.) and a transceiver (e.g., a device to send and emit energy and/or data). Moreover, the sensing device 70 may be a contact sensor (e.g., contacts the sidewall 20) or a non-contact sensor.

The sensing device 70 is communicatively coupled to a controller 72 having a processor 74 and a memory 76. The memory 76 is a non-transitory (not merely a signal), computer-readable media, which may include executable instructions that may be executed by the processor 74. For example, the controller 72 may receive a signal from the sensing device 70 indicative of a borehole property (e.g., a resistivity measurement of the formation). In certain embodiments, the memory 76 may store the signal for later evaluation. However, in other embodiments, the processor 74 may evaluate the signal for use during drilling, completion, cementing, or other borehole operations. Additionally, in some embodiments, the controller 72 may send the signal to a communication device 78 for transmission from the sensor 34 to the drill string 14 and/or a surface controller. For example, the communication device 78 may include a wired or wireless communication system (e.g., Ethernet, fiber optic, cellular, mud pulse, etc.) to transmit data from the sensor to other parts of the drill string 14 and/or a surface controller. Accordingly, data acquired by the sensor 34 may be utilized during borehole operations. As described above, the springs 38 of the calipers 32 may include integrated sensors 34 for obtaining borehole measurements during borehole operations. For example, the sensors 34 may be fastened to the springs 38 and urged to move radially, relative to the logging tool axis 36, with the calipers 32.

Figure 5:
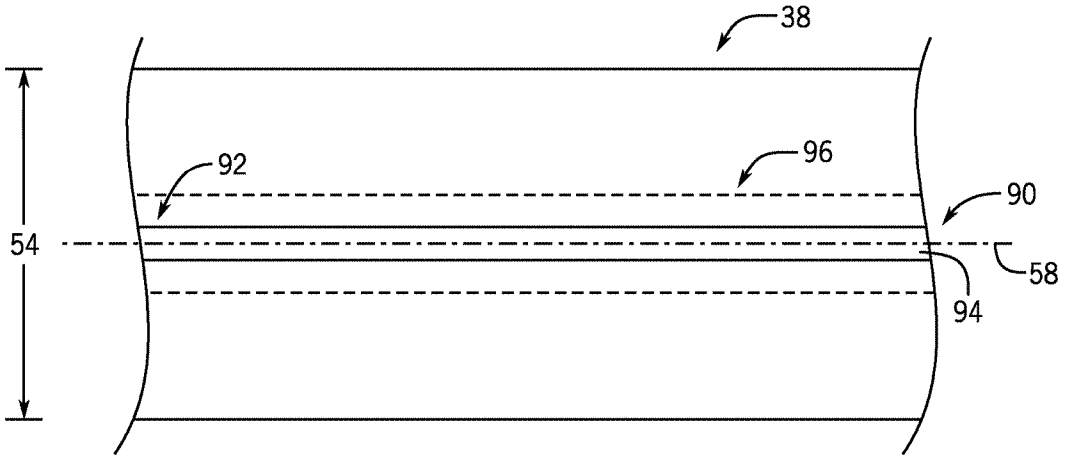
FIG. 5 shows a partial schematic top view of an embodiment of a groove formed in the caliper tool of FIG. 2, in accordance with various embodiments of the present disclosure.

FIG. 5 is a partial top view of an embodiment of the spring 38. In the illustrated embodiment, the spring 38 includes a groove 90 extending along the spring axis 58. The groove 90 extends a first depth 92 into the spring 38, transverse to the spring axis 58. In certain embodiments, the first depth 92 is twenty percent of the spring depth 68. However, in other embodiments, the first depth 92 may be thirty percent of the spring depth 68, forty percent of the spring depth 68, fifty percent of the spring depth 68, sixty percent of the spring depth 68, seventy percent of the spring depth 68, or any suitable percentage of the first depth 92. The groove 90 further includes a slot 94 and a channel 96 substantially shaped like a "T". However, in other embodiments, the slot 94 and channel 96 may be different shapes. For example, the groove may have a substantially I-shaped cross section, H-shaped cross section, V-shaped cross section, or any other suitable shape.

In certain embodiments, the groove 90 may be utilized to provide a routing path for wired communication to and/or from the sensor 34. For example, communication cables (e.g., fiber optics, Ethernet, etc.) may be positioned within the slot 94 and/or the channel 96 to communicatively couple the sensor 34 to the drill string 14. In certain embodiments, the communication cables may be insulated and/or coated. For example, the communication cables may be polymer-coated (e.g., TEFLON, polytetrafluoroethylene, plastics, polymers). By coating the communication cables, friction between the communication cables and the groove 90 may be reduced. As a result, the communication cables are secured within the spring 38, thereby decreasing the likelihood of wear due to direct exposure to the borehole environment. Additionally, forming the groove 90 in the springs 38 obviates additional attachment coupled to the spring 38 (e.g., welded, bolted, etc.) to protect and/or route the communication cables.

Inclusion of the groove 90 utilizes a reduced portion of material comprising the spring 38. As a result, the bending strength of the spring 38 may be substantially equal to a spring not having the groove 90. However, a small amount of material may be added to the spring 38 to maintain bending strength. As shown, the groove 90 extends along the spring axis 58. Because the groove 90 is along the spring axis 58, length compensation of the communication cables may be reduced or eliminated because the spring axis 58 length remains substantially the same.

Figure 6:
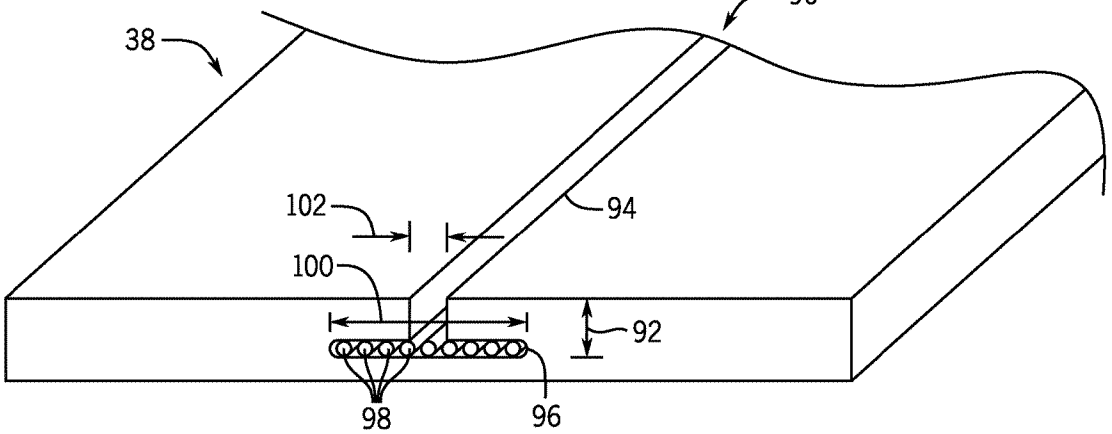
FIG. 6 shows a partial perspective cross-sectional view of the groove of FIG. 5, in accordance with various embodiments of the present disclosure.

FIG. 6 is a partial cross-sectional perspective view of the groove 90 positioned within the spring 38. As mentioned above, the groove 90 includes the generally T-shaped channel 96 and slot 94. Moreover, communication cables 98 are positioned within the channel 96. The channel 96 is sized to accommodate the size of the communication cables 98, but to reduce and/or eliminate substantial movement of the communication cables 98 to reduce and/or eliminate fretting or other potentially degrading contact between the communication cables 98 and the spring 38. Moreover, limiting the movement of the communication cables 98 may reduce noise in the signal being transmitted via the communication cables 98. As shown, the channel 96 has a channel width 100 that is larger than a slot width 102 of the slot 94. As a result, upward movement (e.g., movement transverse to the spring axis 58) is substantially blocked because of the solid portion of the spring 38 positioned above a substantial portion of the channel 96. In the illustrated embodiment, the groove 90 extends the length of the spring 38. However, in other embodiments, the groove 90 may only extend along a partial length of the spring 38. For example, in embodiments where the spring 38 is formed from multiple pieces, the groove 90 may be positioned in the spring 38*a* and not in the spring 38*b*. Additionally, while the groove 90 is described above as being incorporated in the spring 38, in other embodiments the groove 90 may be incorporated in the drill string 14, in linkages positioned along the drill string 14, or any other suitable location.

In certain embodiments, the groove 90 may be machined into the material utilized to form the spring 38. For example, the groove may be cut (e.g., laser cut, water cut, etc.) along the spring axis 58. Then, the spring 38 may be formed, heated treated, and the like. Accordingly, the spring 38 may be formed with properties particularly selected to accommodate the groove 90. However, in other embodiments, the groove 90 may be machined into the spring 38 after the spring forming process.

Figure 7:
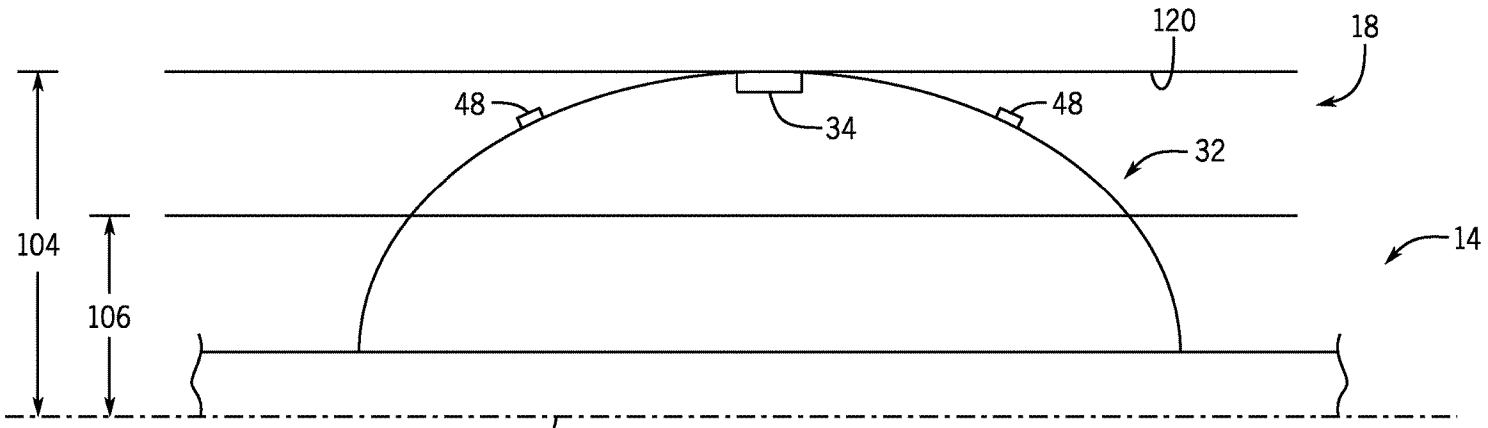
FIG. 7 shows a partial schematic cross-sectional view of the caliper tool of FIG. 2 disposed in a borehole, in which a sensor contacts a sidewall of the borehole, in accordance with various embodiments of the present disclosure.

FIG. 7 is a partial cross-sectional view of an embodiment of the logging tool 30 disposed in the borehole 18. In the illustrated embodiment, the calipers 32 are radially extended, relative to the logging tool axis 36. That is, the spring force drives the calipers 32 radially outward until the sidewall 20 is contacted or the maximum elongation of the springs 38 is reached. As shown, the force of the springs 38 drives the sensor 34 against the sidewall 20 of the borehole 18 at a first distance 104. Accordingly, the sensor 34 may obtain measurements from the borehole 18. As shown, the first distance 104 extends farther than the position of the bumpers 48. As will be described below, in embodiments where the sidewall 20 is at the second distance 106 the bumpers 48 may contact the sidewall 20 before the sensor 34. However, in other embodiments, the sidewall 20 may be replaced by the interior surface of the tubular as the logging tool 30 is disposed within the borehole 18.

In operation, the caliper tool 32 (e.g., caliper) may be activated when the logging tool 30 is extended through the drill bit 16. Thereafter, the spring force may drive the sensor 34 toward the sidewalls 20 of the borehole 18, with respect to the logging tool axis 36. Additionally, in certain embodiments, the logging tool 30 may remain extended through the drill bit 16 while the drill string 14 is removed from the borehole 18. For example, the caliper tool 32 may continually take measurements of the borehole 18 as the drill string 14 is removed from the borehole 18 because the sidewall 20 will continue to act on the calipers 32 (e.g., enable compression or expansion of the springs 38) as the drill string 14 is removed from the borehole 18.

Figure 8:
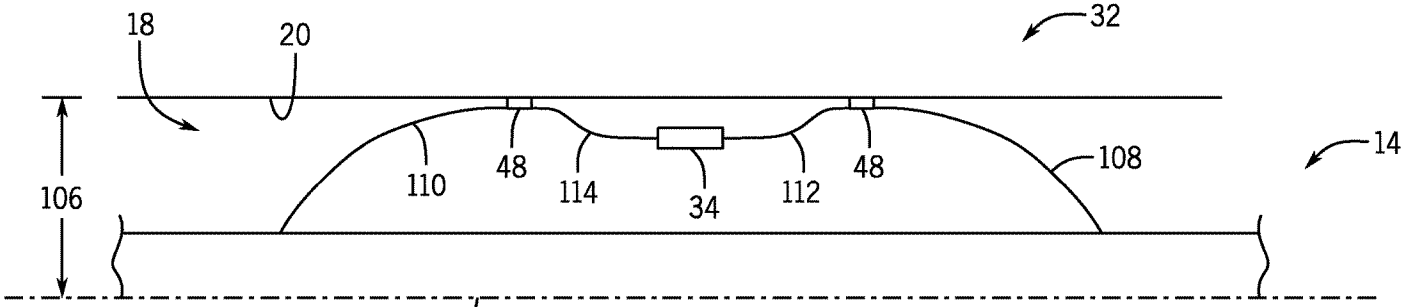
FIG. 8 shows a partial schematic cross-sectional view of the caliper tool of FIG. 2 disposed in a borehole, in which bumpers contact a sidewall of the borehole, in accordance with various embodiments of the present disclosure.

FIG. 8 is a partial cross-sectional view of an embodiment of the logging tool disposed in the borehole 18. As shown, the sidewall 20 is positioned at the second distance 106 and the bumpers 48 contact the sidewall 20. However, as described above, in certain embodiments the bumpers 48 may contact the interior surface of the tubular as the logging tool 30 is disposed within the borehole 18. Additionally, in the illustrated embodiment, the spring 38 is formed from multiple sections. As described above, the spring 38 may include sections of spring material. A first spring section 108 and a second spring section 110 are generally convex, relative to the logging tool axis 36. That is, the first and second spring sections 108, 110 drive the sensor 34 toward the sidewall 20. However, a third spring section 112 and a fourth spring section 114 are generally concave, relative to the logging tool axis 36. Accordingly, the third and fourth spring sections 112, 114 drive the sensor 34 away from the sidewall 20 (or in other embodiments, the interior surface of the tubular) and toward the logging tool axis 36.

As shown, the transition between the first and third spring sections 108, 112 and the second and fourth spring sections 110, 114 is located at the bumpers 48. As the bumpers 48 contact the sidewall 20, the third and fourth spring sections 112, 114 bias the sensor 34 away from the sidewall 20. Accordingly, the sensor 34 is suspended within the borehole 18 and does not contact the sidewall 20. Moreover, in other embodiments, the sensor 34 may be suspended within the tubular and not contact the interior surface of the tubular. In certain embodiments, the sensor 34 may obtain fluid samples in the annulus 22 while the bumpers 48 are in contact with the sidewall 20. In certain embodiments, the third and fourth spring sections 112, 114 bias the sensor 34 toward the sidewall 20 while the bumpers 48 are not in contact with the sidewall 20.

As described above, the caliper 32 may include springs 38 that radially move the sensor 34 relative to the logging tool axis 36. In certain embodiments, the springs 38 include the sensor 34 integrated into the springs 38. That is, the sensor 34 may join two springs via fasteners 64 to form the caliper 32. Additionally, in other embodiments, the springs 38 may include the groove 90 to route communication cables 98 from the sensor 34 to the drill string 14. The groove 90 may be positioned along the spring axis 58. Furthermore, the springs 38 may include bumpers 48 that contact the sidewall 20. The bumpers 48 may be positioned on different sides of the sensor 34 and contact the sidewall 20 before the sensor 34. As a result, the spring sections 112, 114 may drive the sensor 34 away from the sidewall 20.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

What is claimed is:

1. A downhole tool, comprising:

a logging tool comprising a spring integral with a sensor, wherein the spring is configured to apply the sensor to a formation wall, and wherein the spring comprises a groove formed along a neutral axis thereof, and wherein a wire is located within the groove and is operatively connected with the sensor and at least one other component of the logging tool, wherein the groove has a substantially T-shaped cross section.

2. The downhole tool of claim 1, wherein the spring comprises a first section and a second section, the first section being coupled to the sensor at a first end and the second section being coupled to the sensor at a second end.

3. The downhole tool of claim 1, wherein the sensor comprises:

a housing disposed about the spring and coupled to the spring via a fastener;

a sensing device configured to send energy into a formation and to receive energy from the formation;

a controller configured to receive data from the sensing device; and a communication device configured to transmit the data to the logging tool.

4. The downhole tool of claim 1, wherein the wire comprises a polymer-coated communication cable.

5. The downhole tool of claim 1, wherein the groove extends along substantially an entire length of the spring.

6. The downhole tool of claim 1, comprising a first bumper and a second bumper positioned on the spring, wherein the sensor is positioned between the first bumper and the second bumper.

7. The downhole tool of claim 6, wherein the spring comprises:

a first section coupling the logging tool at the second location to the first bumper;

a second section coupling the logging tool at the first location to the second bumper;

a third section coupling the first bumper to the sensor; and a fourth section coupling the second bumper to the sensor;

wherein the first and second sections are substantially convex, relative to the logging tool axis, while the first and second bumpers contact a surface, and the third and fourth sections are substantially concave, relative to the logging tool axis, while the first and second bumpers contact the surface.

8. The downhole tool of claim 7, wherein the first, second, third, and fourth sections are substantially convex, relative to the logging tool axis, while the sensor contacts the surface.

9. The downhole tool of claim 7, wherein the first and second bumpers are configured to contact the surface while a distance between the sidewall and the logging tool axis is less than or equal to a first distance, and the sensor is configured to contact the surface while the distance between the sidewall and the logging tool axis is greater than the first distance.

10. A downhole tool, comprising:

a drill string configured to be disposed in a borehole in a formation;

a drill bit coupled to an end of the drill string, wherein the drill bit is configured to engage the formation to form the borehole; and a logging tool positioned within the drill string and configured to extend therefrom, wherein the logging tool comprises a spring integral with a sensor, wherein the spring is configured to apply the sensor to a formation wall, and wherein the spring comprises a groove formed along a neutral axis thereof, and wherein a wire is located within the groove and is operatively connected with the sensor and at least one other component of the logging tool, wherein the groove has a substantially T-shaped cross section.

11. The downhole tool of claim 10, comprising a bumper positioned on the spring, wherein the bumper is configured to prevent a sensor on the spring from contacting an interior surface of a tubular during conveyance of the logging tool into the borehole.

12. The downhole tool of claim 10, wherein the logging tool is configured to remain extended through the drill bit while the drill string is removed from the borehole.

13. The downhole tool of claim 10, wherein the spring comprises an integral sensor configured to obtain borehole measurements.

14. The downhole tool of claim 10, wherein the groove extends along substantially an entire length of the spring.

15. A downhole tool, comprising:

a logging tool comprising a spring integral with a sensor, wherein the spring is configured to apply the sensor to a formation wall, and wherein the spring comprises:

a groove formed along a neutral axis thereof, and wherein a wire is located within the groove and is operatively connected with the sensor and at least one other component of the logging tool;

a first bumper positioned on thereon;

a second bumper positioned thereon, wherein the sensor is positioned between the first bumper and the second bumper;

a first section coupling the logging tool at the second location to the first bumper;

a second section coupling the logging tool at the first location to the second bumper;

a third section coupling the first bumper to the sensor; and a fourth section coupling the second bumper to the sensor; wherein the first and second sections are substantially convex, relative to the logging tool axis, while the first and second bumpers contact a surface, and the third and fourth sections are substantially concave, relative to the logging tool axis, while the first and second bumpers contact the surface.

16. The downhole tool of claim 15, wherein the first, second, third, and fourth sections are substantially convex, relative to the logging tool axis, while the sensor contacts the surface.

17. The downhole tool of claim 15, wherein the first and second bumpers are configured to contact the surface while a distance between the sidewall and the logging tool axis is less than or equal to a first distance, and the sensor is configured to contact the surface while the distance between the sidewall and the logging tool axis is greater than the first distance.

* * * * *